US012137849B2

(12) United States Patent
Tran

(10) Patent No.: US 12,137,849 B2
(45) Date of Patent: Nov. 12, 2024

(54) MULTI POSITION FOOT REST

(71) Applicant: Gulfstream Inc., Cambridge (CA)

(72) Inventor: Minh Sang Tran, Cambridge (CA)

(73) Assignee: Gulfstream Inc., Cambridge (CA)

( * ) Notice: Subject to any disclaimer, the term of this patent is extended or adjusted under 35 U.S.C. 154(b) by 73 days.

(21) Appl. No.: 18/093,960

(22) Filed: Jan. 6, 2023

(65) Prior Publication Data

US 2023/0218119 A1 Jul. 13, 2023

Related U.S. Application Data

(60) Provisional application No. 63/297,678, filed on Jan. 7, 2022.

(51) Int. Cl.

| | |
|---|---|
| ***A47K 3/022*** | (2006.01) |
| ***A47C 1/06*** | (2006.01) |
| ***A47K 3/12*** | (2006.01) |

(52) U.S. Cl.

CPC ..... *A47K 3/122* (2013.01); *A47C 1/06* (2013.01); *A47K 3/022* (2013.01)

(58) Field of Classification Search

CPC ..... A47K 3/022; A47K 3/122; A47C 1/06
USPC ..... 4/574.1
See application file for complete search history.

(56) References Cited

U.S. PATENT DOCUMENTS

| | | | | |
|---|---|---|---|---|
| 7,490,374 | B2 * | 2/2009 | Fugate | A61H 35/006 4/574.1 |
| 8,726,430 | B2 * | 5/2014 | Tran | A47C 1/11 4/574.1 |
| 2011/0010843 | A1 * | 1/2011 | Galati, Jr | A47K 3/022 4/622 |
| 2011/0010844 | A1 * | 1/2011 | Ton | A47K 3/022 4/622 |
| 2020/0197259 | A1 * | 6/2020 | Estrada | A47C 1/11 |

* cited by examiner

*Primary Examiner* — Huyen D Le
(74) *Attorney, Agent, or Firm* — MaxGoLaw PLLC

(57) ABSTRACT

An apparatus for use by a seated person includes a pad for each leg, having a base and an end and, in use: a first position exists that has the base is proximal and the end is distal to the seat and the pad extends horizontally from base to end; a second position with the end is proximal to and the base is distal to the seat and the pad extends horizontally from base to end; a third position with the base is proximal and the end is distal to the seat and the end is elevated above the base; a fourth position with the end is proximal to and the base is distal to the seat and the end is elevated above the base, the pads being positioned such that when similarly positioned, the pads are spaced apart in the direction between the ischial bones of the person.

7 Claims, 25 Drawing Sheets

MULTI POSITION FOOT REST

RELATED APPLICATIONS

This application claims priority benefit of U.S. Provisional Application Ser. No. 63/297,678 filed on Jan. 7, 2022; the contents of which are hereby incorporated by reference.

FIELD OF THE INVENTION

The invention relates to the field of esthetics.

BACKGROUND

In the field of esthetics, it is well known for salons to provide foot spas, wherein the feet of patrons can be soaked. It is also well known for foot spas to incorporate foot rests, wherein the feet of patrons can rest, out of the water, while a manicurist works. However, since patrons and manicurists vary greatly in stature, prior art foot spas do not always provide optimal levels of comfort to the patron and esthetician.

SUMMARY OF THE INVENTION

Forming one aspect of the invention is apparatus for use by a two-legged person and with a foot spa subassembly.

The subassembly includes a seat and a bowl. The bowl is disposed beneath the seat and adapted for receiving water.

The seat and bowl are adapted such that the feet of the person can, in use, be immersed in water in the bowl while the seat is operatively occupied by the person.

The apparatus comprises a pad provided for each leg of the person, the pad being positioned in use such that the bowl is disposed between and beneath the seat and the pad, the pad having a base and an end and having, in use:

a. a first position wherein the base is proximal to the seat, the end is distal to the seat and the pad extends substantially horizontally from the base to the end;

b. a second position wherein the end is proximal to the seat, the base is distal to the seat and the pad extends substantially horizontally from the base to the end;

c. a third position wherein the base is proximal to the seat, the end is distal to the seat and the end is elevated above the base; and d. a fourth position wherein the end is proximal to the seat, the base is distal to the seat and the end is elevated above the base, The pads are positioned relative to one another such that, in use, when the pads are in the same position, the pads are spaced apart from one another in the same direction as that which defines the space between the ischial bones of the seated person.

According to another aspect, the apparatus can further comprise: a hinge for each pad, the hinge defining, in use, a horizontal axis adjacent the base of said each pad; and a shaft and bushing arrangement which defines, in use, a vertical axis about which the hinge rotates, the hinge and shaft and bushing arrangement providing for movement of the pad between the first, second, third and fourth positions.

According to another aspect, the pad can have a planar central portion that, in use, is generally horizontal and presents upwardly in the first and second positions.

1 According to another aspect:

e. the apparatus can further comprise a pintle projecting from the pad opposite to the central portion such that, in the first and second position of the pad, the pintle depends downwardly;

f. the hinge can have a plate which, in use, is planar and which is mounted for pivotal movement around the vertical axis by the shaft and bushing arrangement; and g. the plate can have an aperture presenting upwardly in use which, in the first and second position of the pad, receives the pintle to arrest movement of the plate around the vertical axis.

According to another aspect, the apparatus can further comprise a locking pin pivotally connected to the base at a location adjacent the end and opposite to the central portion, the aperture, in the third and fourth positions of the pad, receiving the locking pin to arrest movement of the plate around the vertical axis and to support the pad in the third and fourth positions.

According to another aspect, the base and end can be radiused so as to present, in combination with the planar central portion a generally convex surface.

According to another aspect, the end of the pad can have a trough-shaped depression that, in use, is generally horizontal and presents upwardly in the third and fourth positions.

Advantages, features and characteristics of the present invention will become apparent upon review of the following detailed description, with reference to the appended drawings, the latter being briefly described hereinafter.

DETAILED DESCRIPTION

Figure 1:
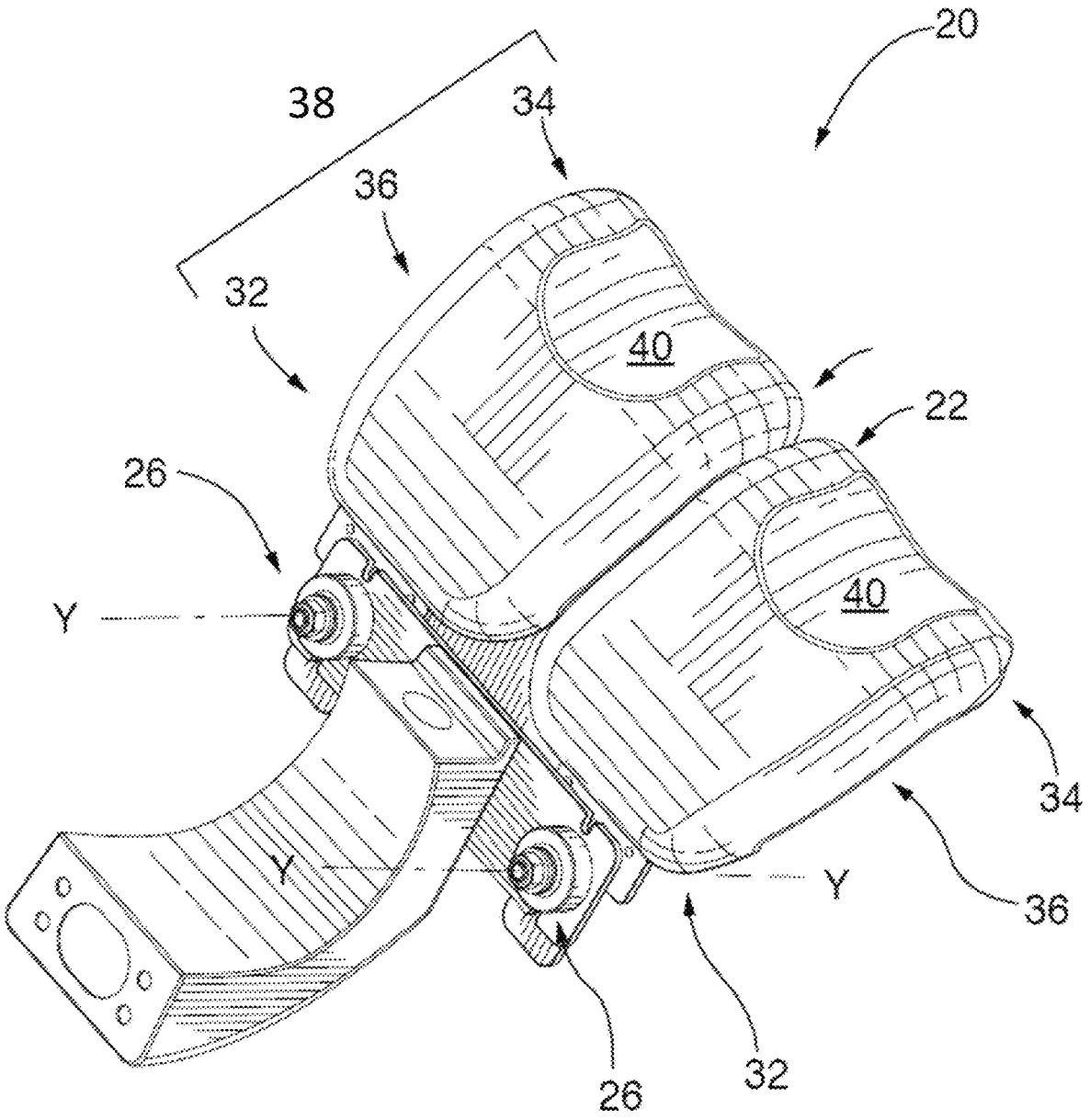
FIG. 1 is a perspective view of apparatus according to an embodiment of the invention.
Figure 2:
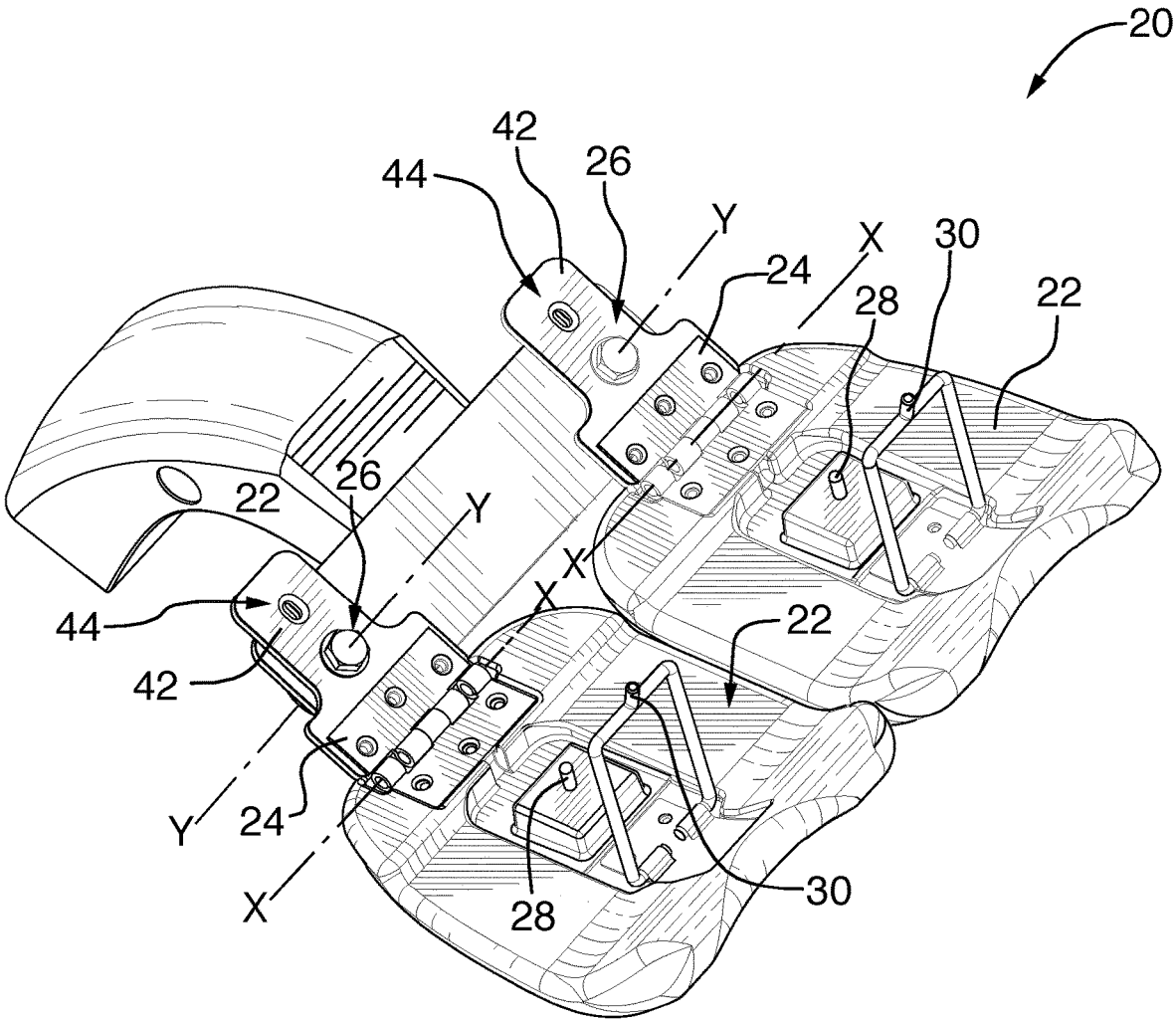
FIG. 2 is another perspective view of apparatus according to an embodiment of the invention.

Apparatus 20 according to an embodiment of the invention is shown in FIG. 1 and FIG. 2 and will be seen to comprise a pair of pads 22, a pair of hinges 24, a pair of shaft and bushing arrangements 26, a pair of pintles 28 and a pair of locking pins 30.

Each pad has a base 32 and an end 34 and a planar central portion 36. The base 32 and ends 34 are radiused so as to present in combination with the planar central portion 36 a generally convex surface 38. The radiused end 34 of the pad has a trough-shaped depression 40.

The hinges 24 are provided one for each pad 22. The hinge 24 defines a pivot axis X-X adjacent the base 32 of said each pad 22 and has a planar plate 42 connected to the pad 22 for movement about the pivot axis X-X. The plate 42 has an aperture 44.

The shaft and bushing arrangements 26 are provided one for each pad. Each defines a rotation axis Y-Y about which the hinge 24 rotates.

The pintles 28 are provided one for each pad 22, each projecting from the pad 22 for which it is provided opposite to the central portion 36 thereof.

The locking pins 30 are provided one for each pad 22, each being pivotally connected to the pad 22 for which it is provided at a location adjacent the end 34 and opposite to the central portion 36.

Figure 3:
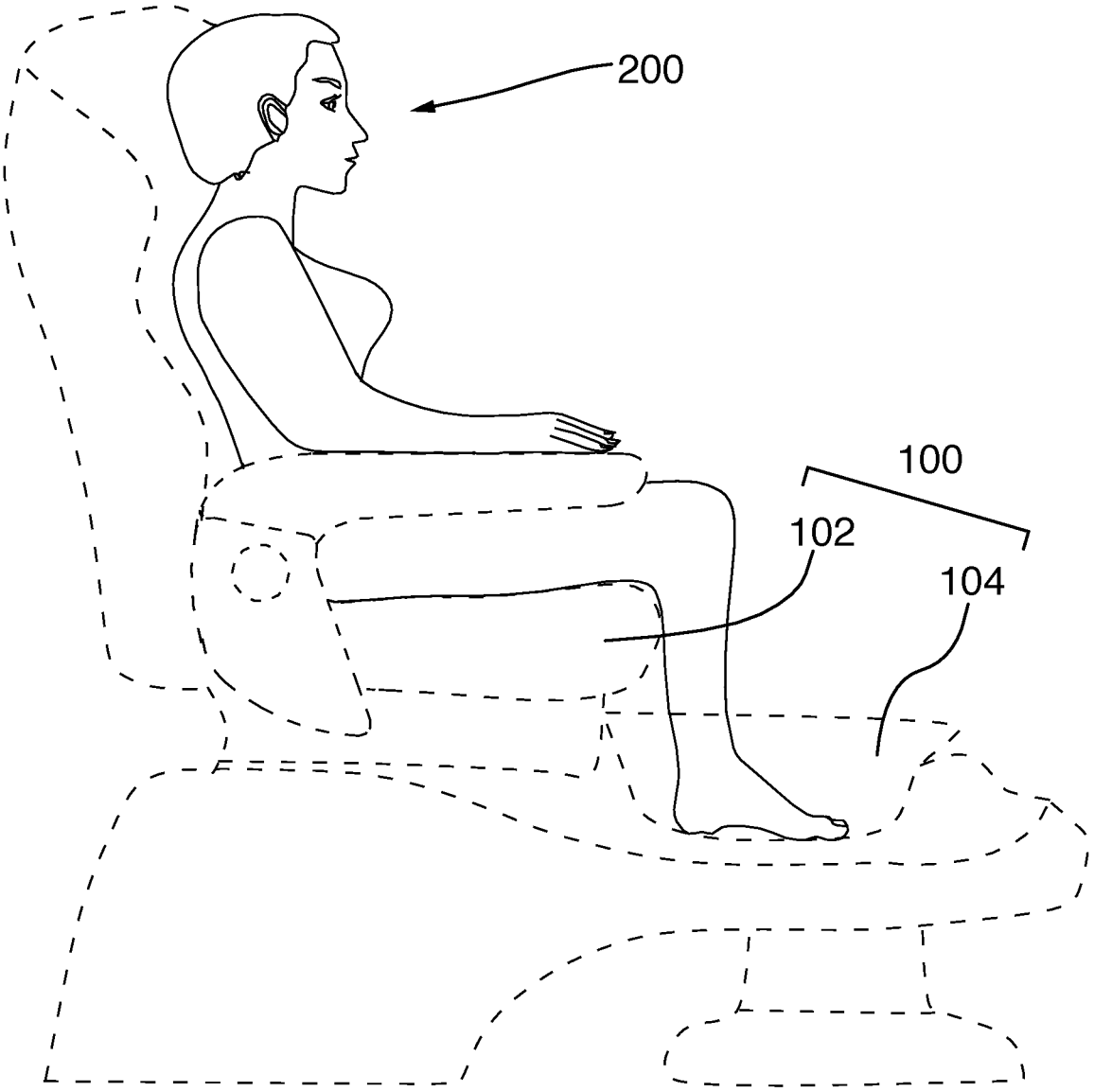
FIG.3 PRIOR ART
FIG. 3 is a side plan view of a person seated a prior art foot spa subassembly.
Figure 4:
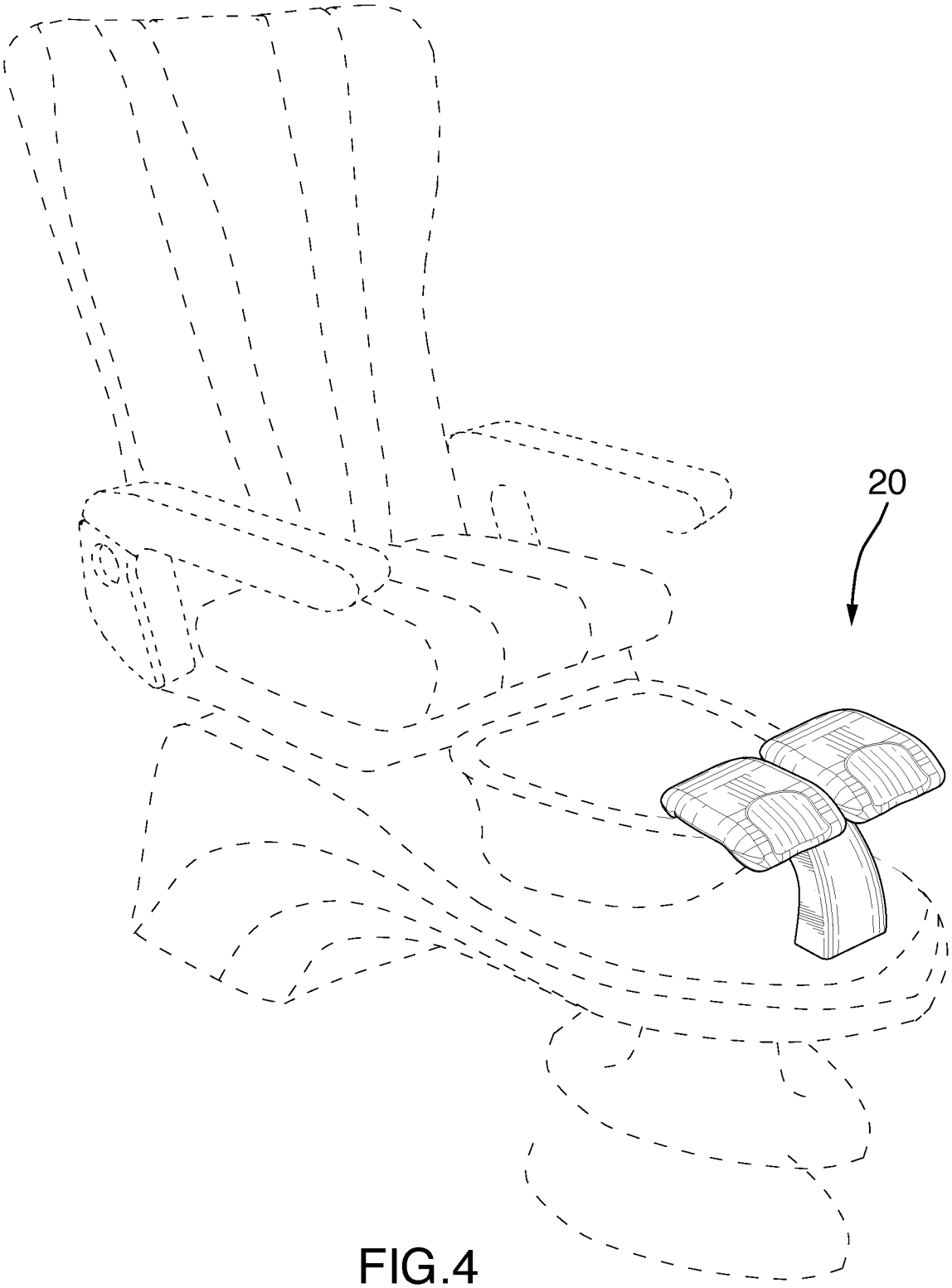
FIG. 4 is a view of the structure of FIG. 1 in use with the structure of FIG. 3, with the left pad in the first position and the right pad in the first position.
Figure 5:
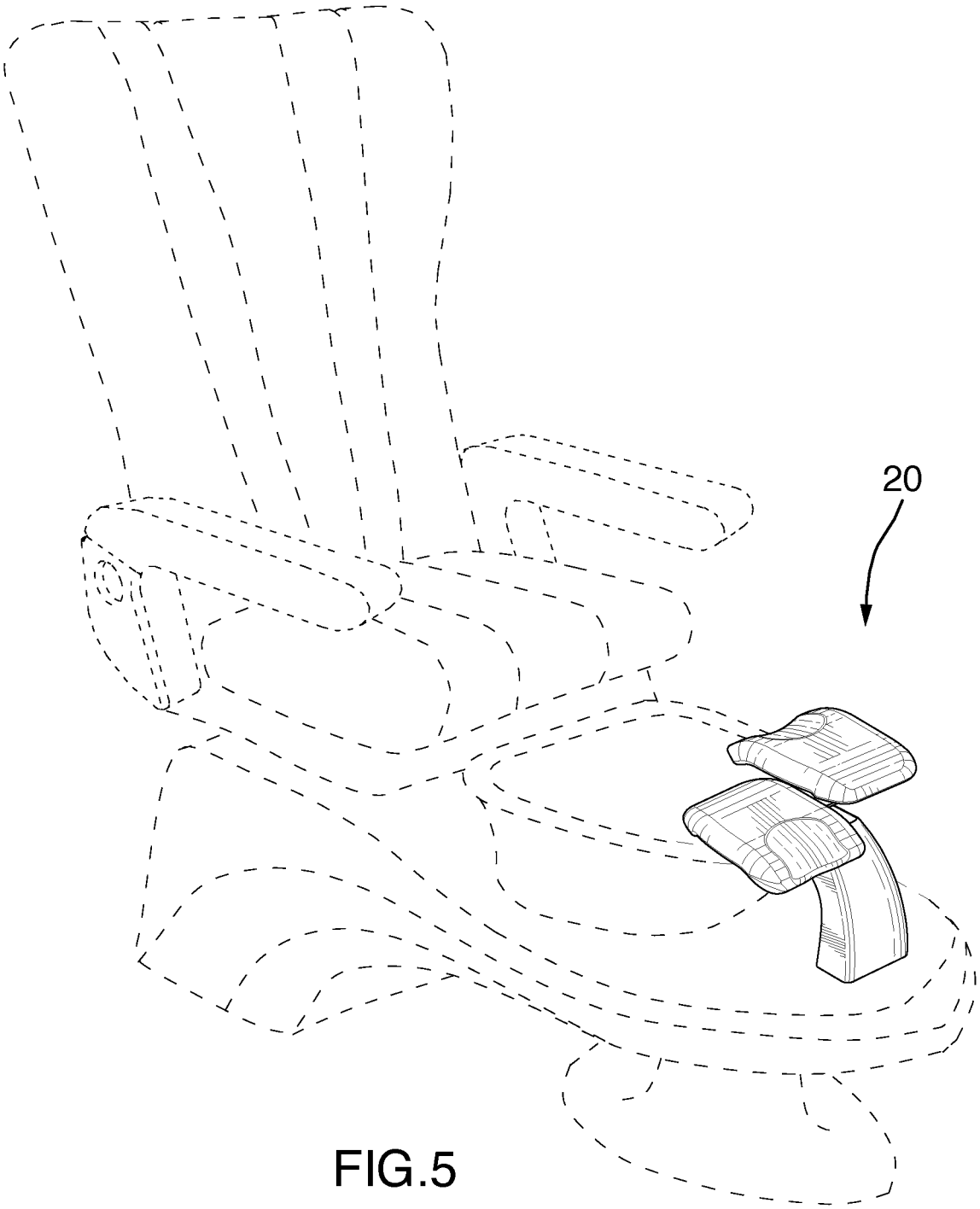
FIG. 5 is a view similar to FIG. 4 with the left pad in the second position and the right pad in the first position.
Figure 6:
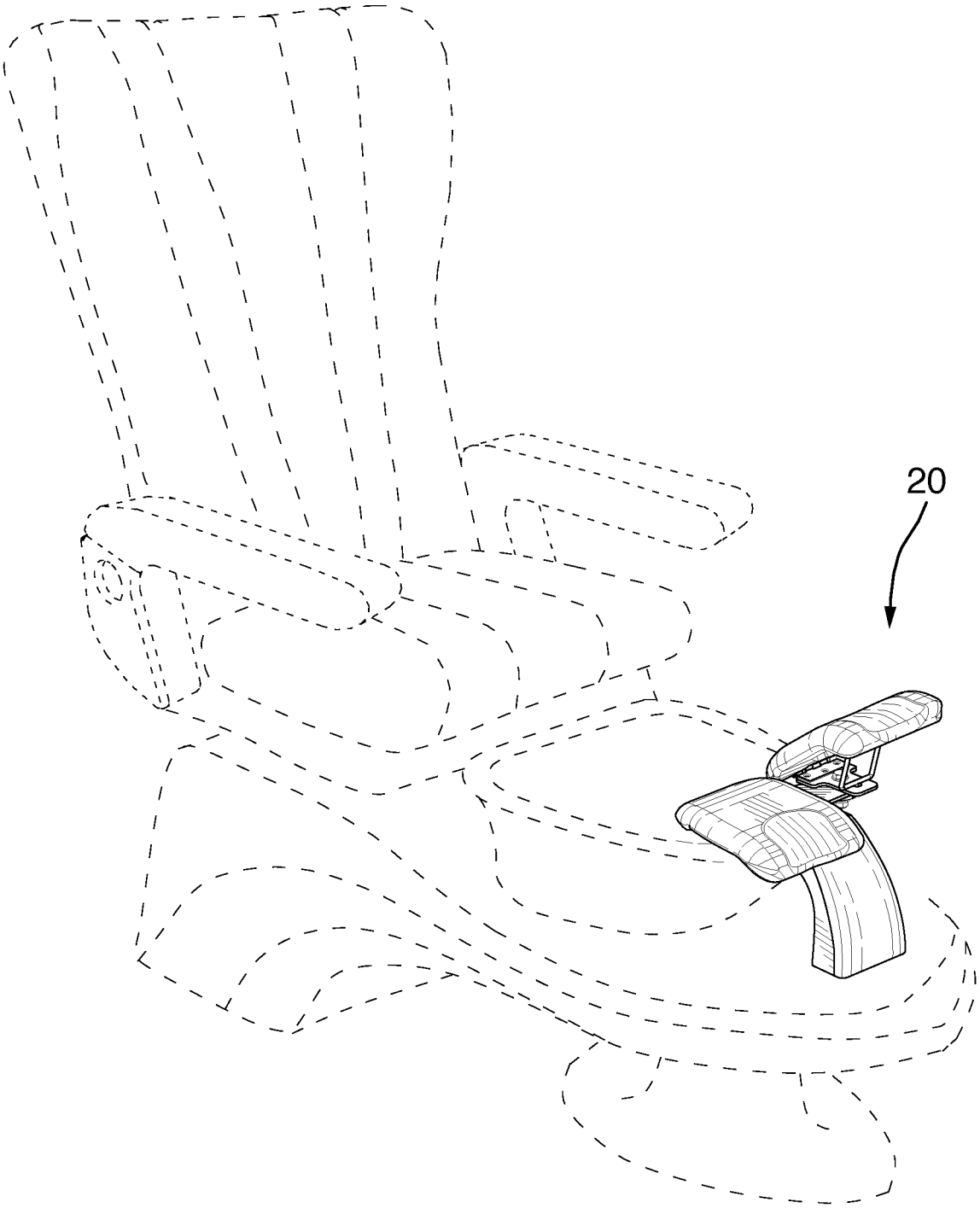
FIG. 6 is a view similar to FIG. 4 with the left pad in the third position and the right pad in the first position.
Figure 7:
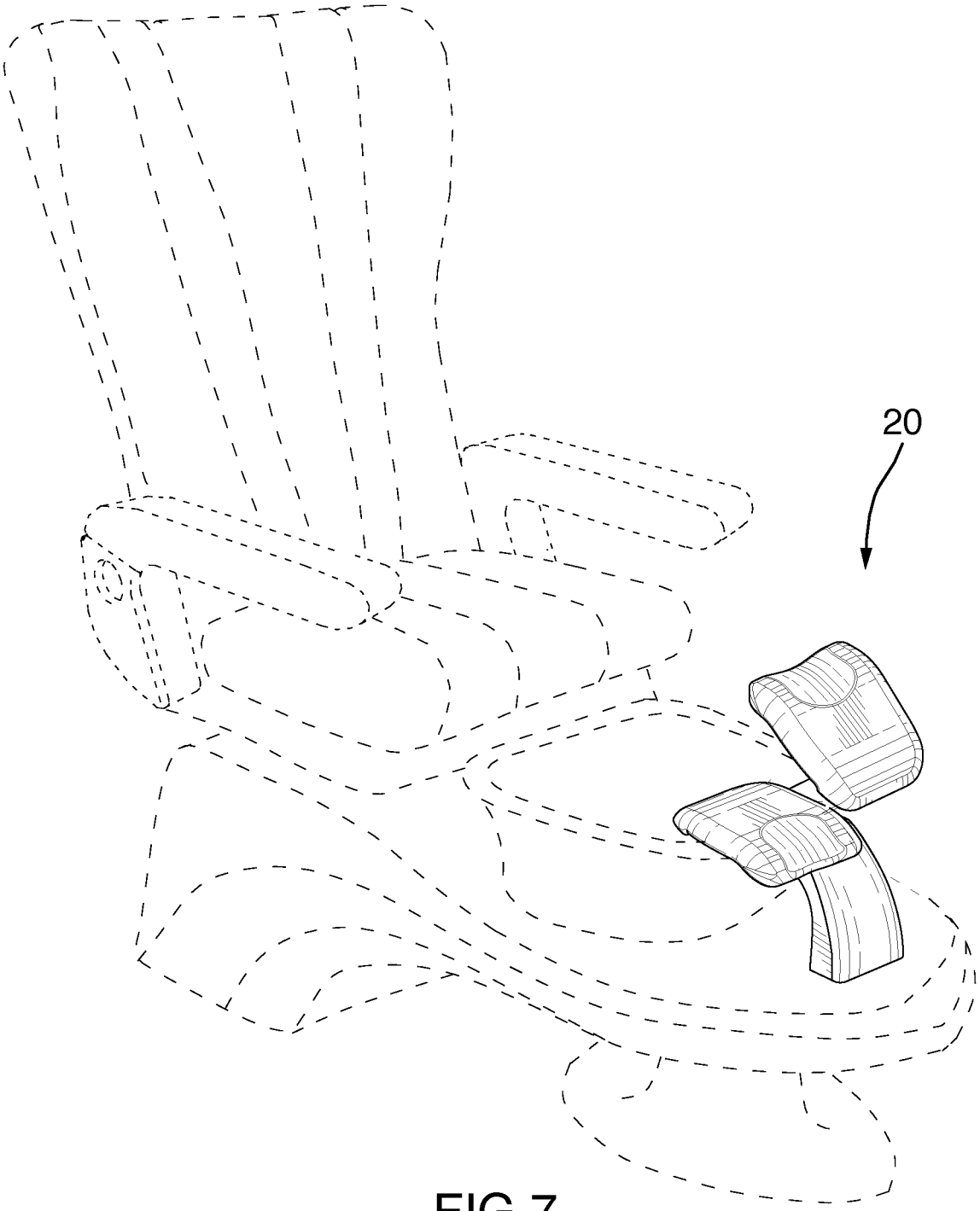
FIG. 7 is a view similar to FIG. 4 with the left pad in the fourth position and the right pad in the first position.
Figure 8:
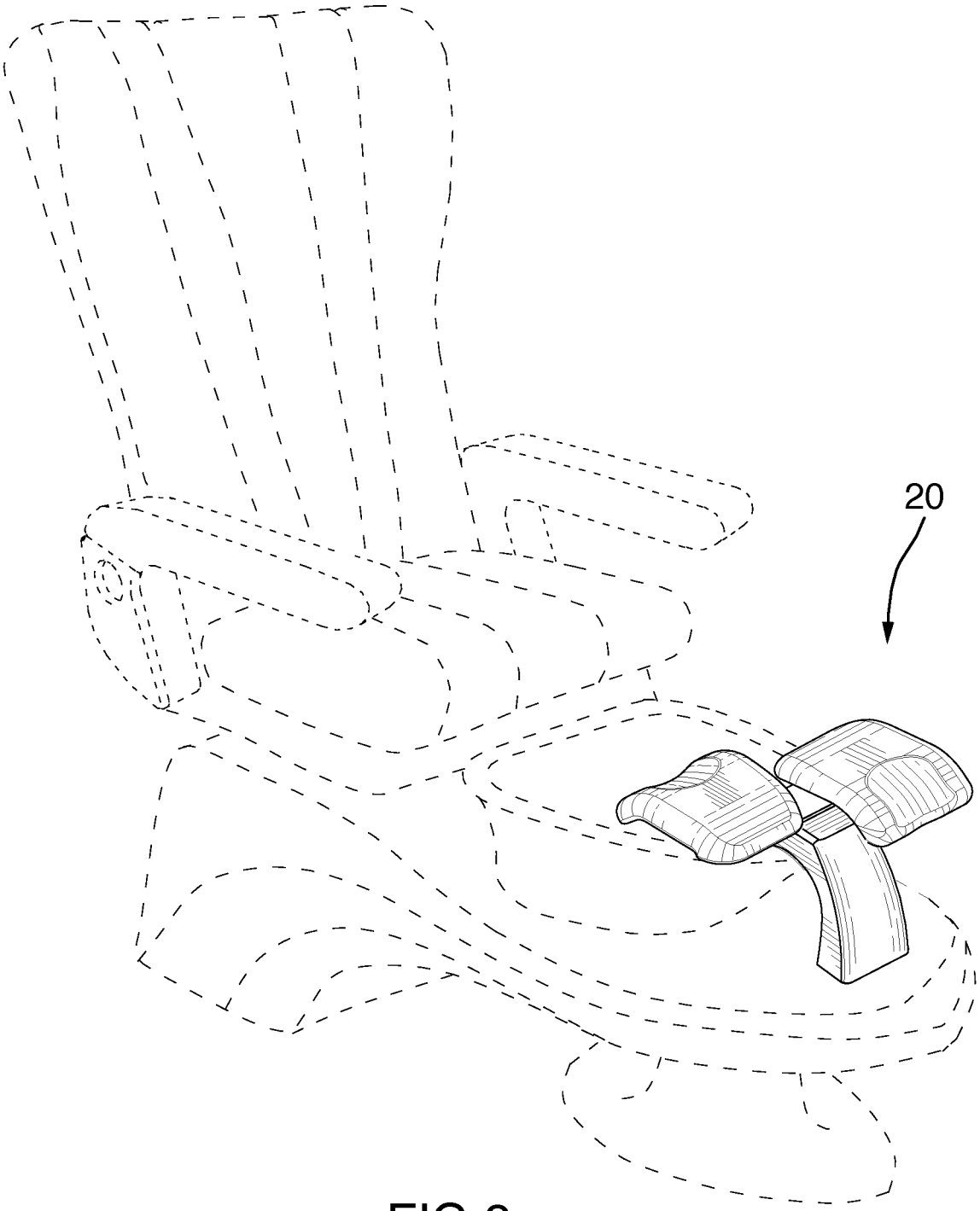
FIG. 8 is a view similar to FIG. 4 with the left pad in the first position and the right pad in the second position.
Figure 9:
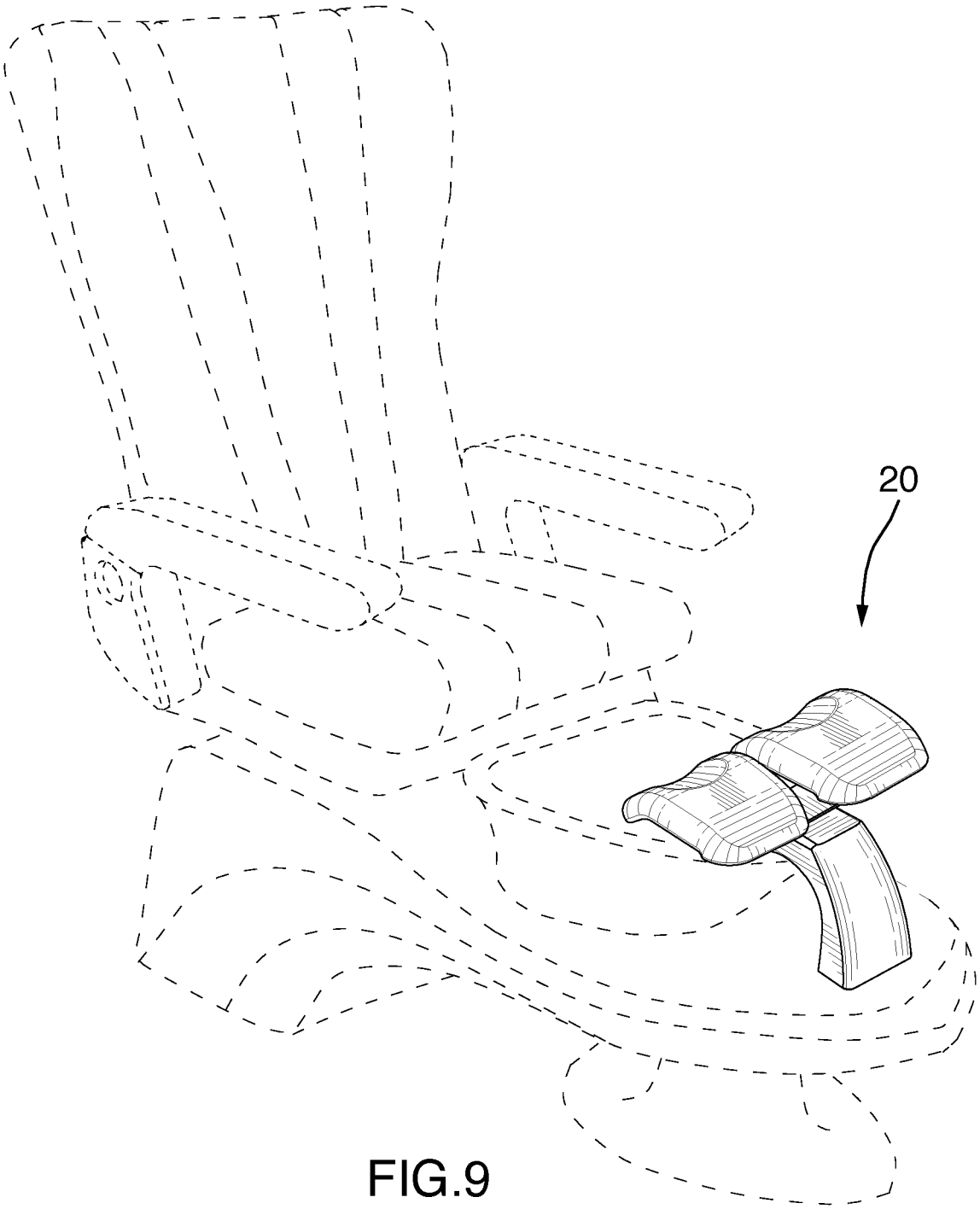
FIG. 9 is a view similar to FIG. 4 with the left pad in the second position and the right pad in the second position.
Figure 10:
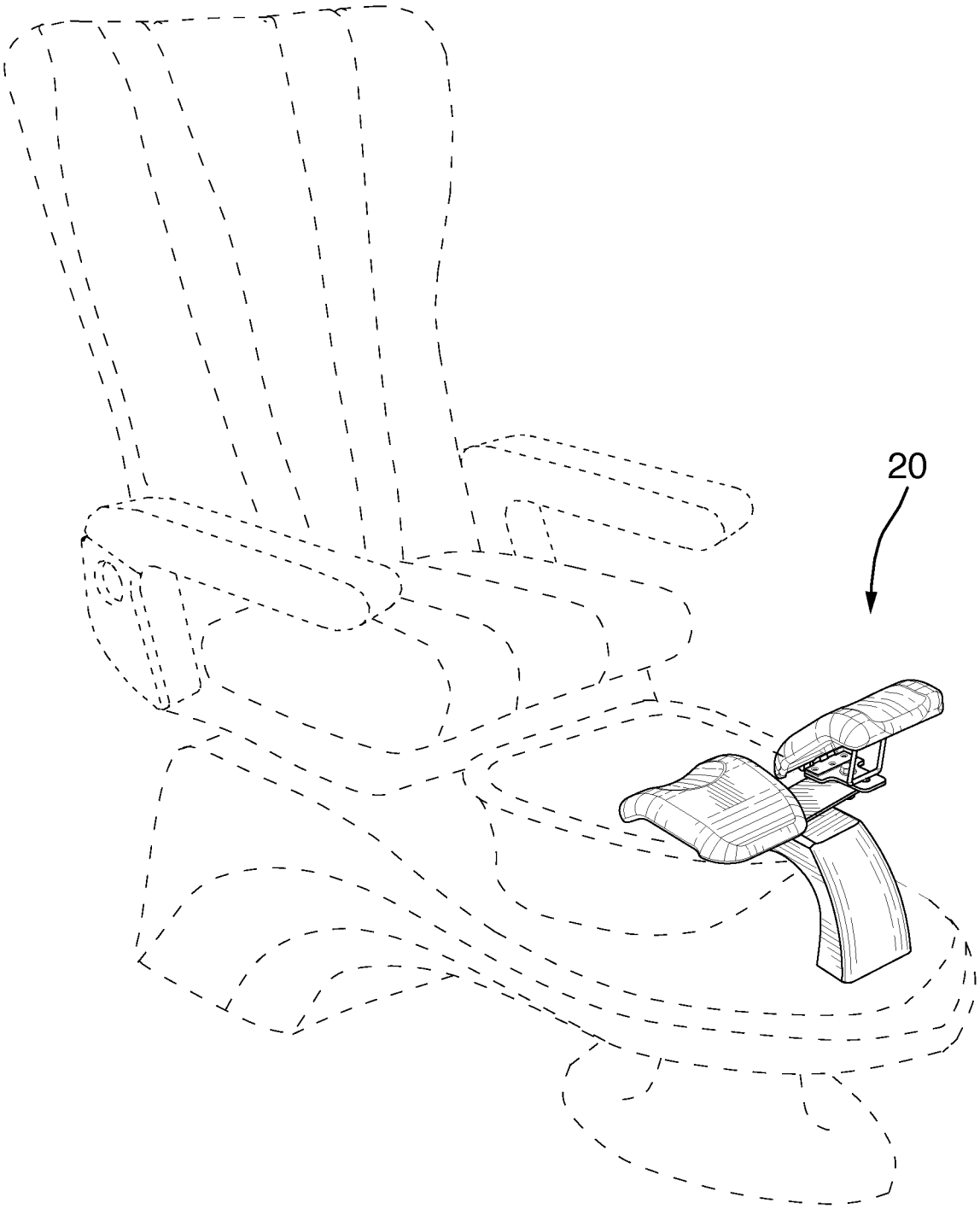
FIG. 10 is a view similar to FIG. 4 with the left pad in the third position and the right pad in the second position.
Figure 11:
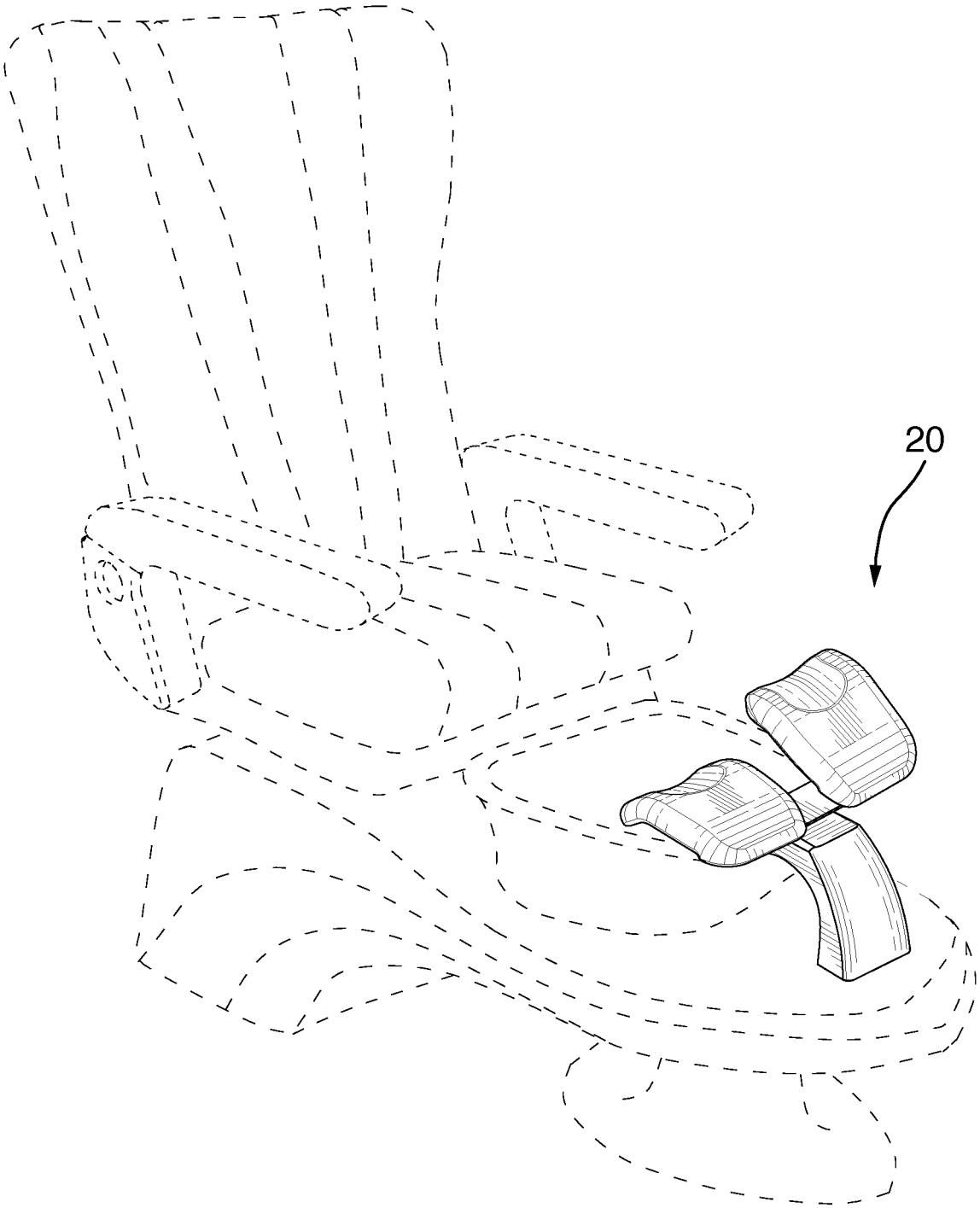
FIG. 11 is a view similar to FIG. 4 with the left pad in the fourth position and the right pad in the second position.
Figure 12:
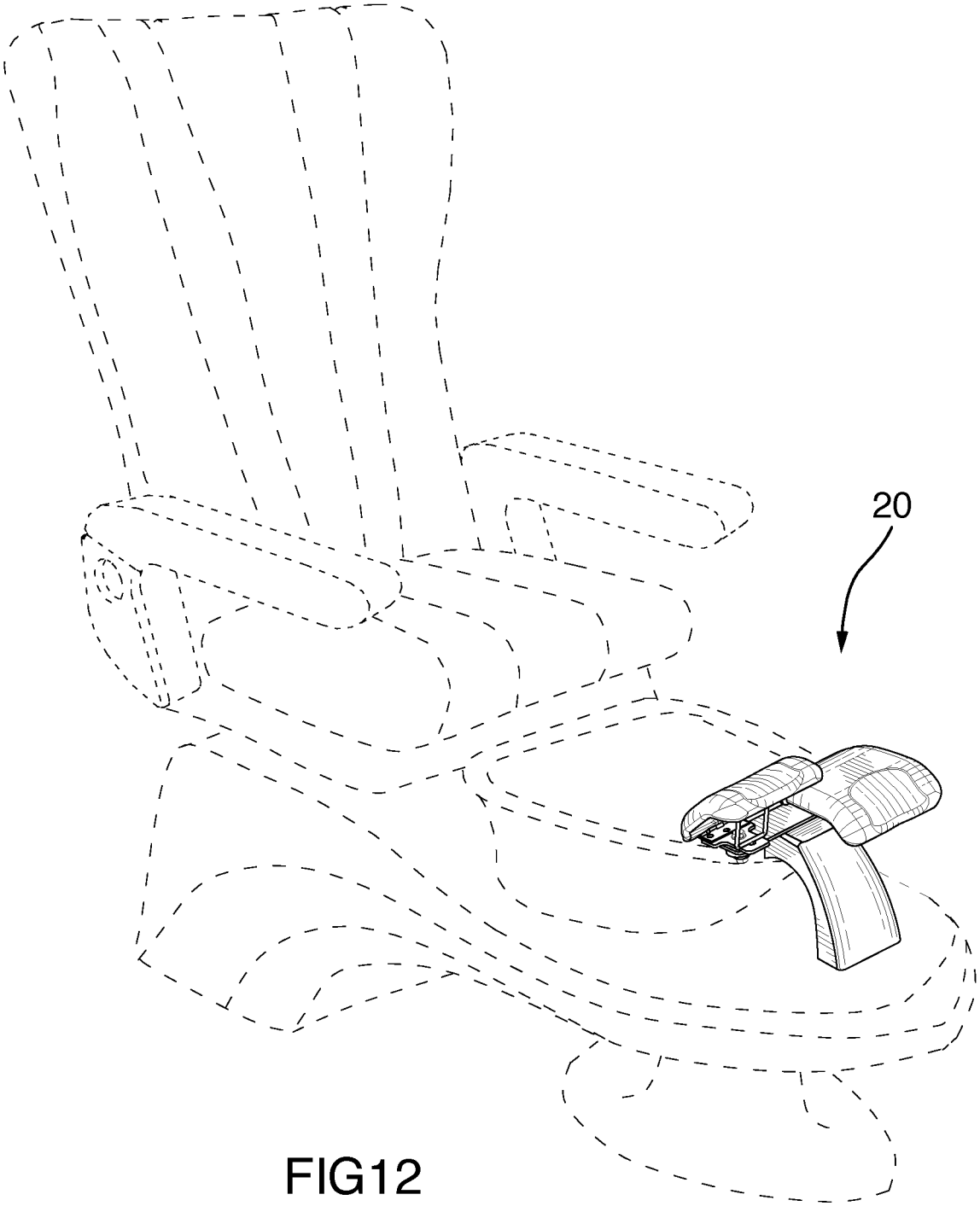
FIG. 12 is a view similar to FIG. 4 with the left pad in the first position and the right pad in the third position.
Figure 13:
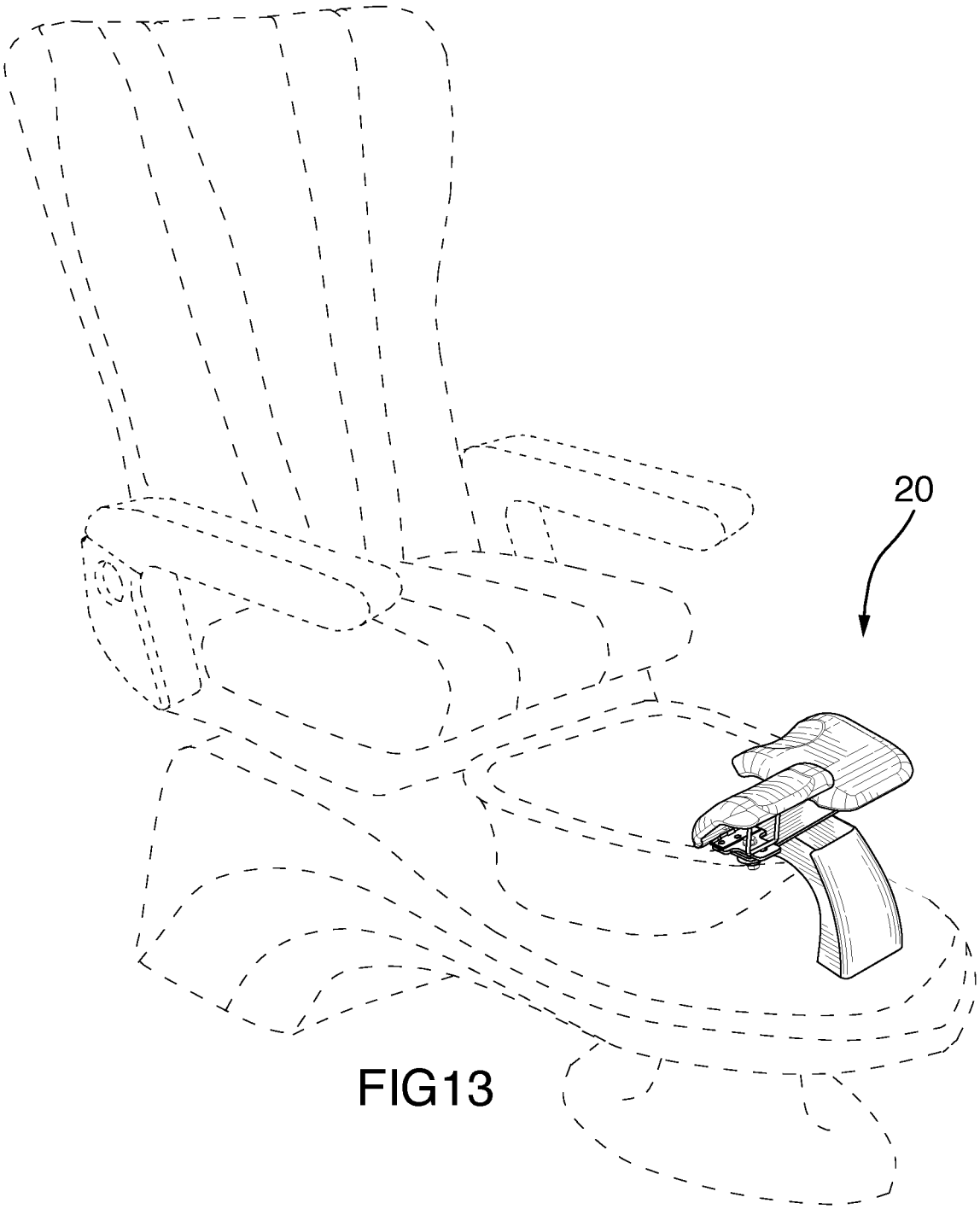
FIG. 13 is a view similar to FIG. 4 with the left pad in the second position and the right pad in the third position.
Figure 14:
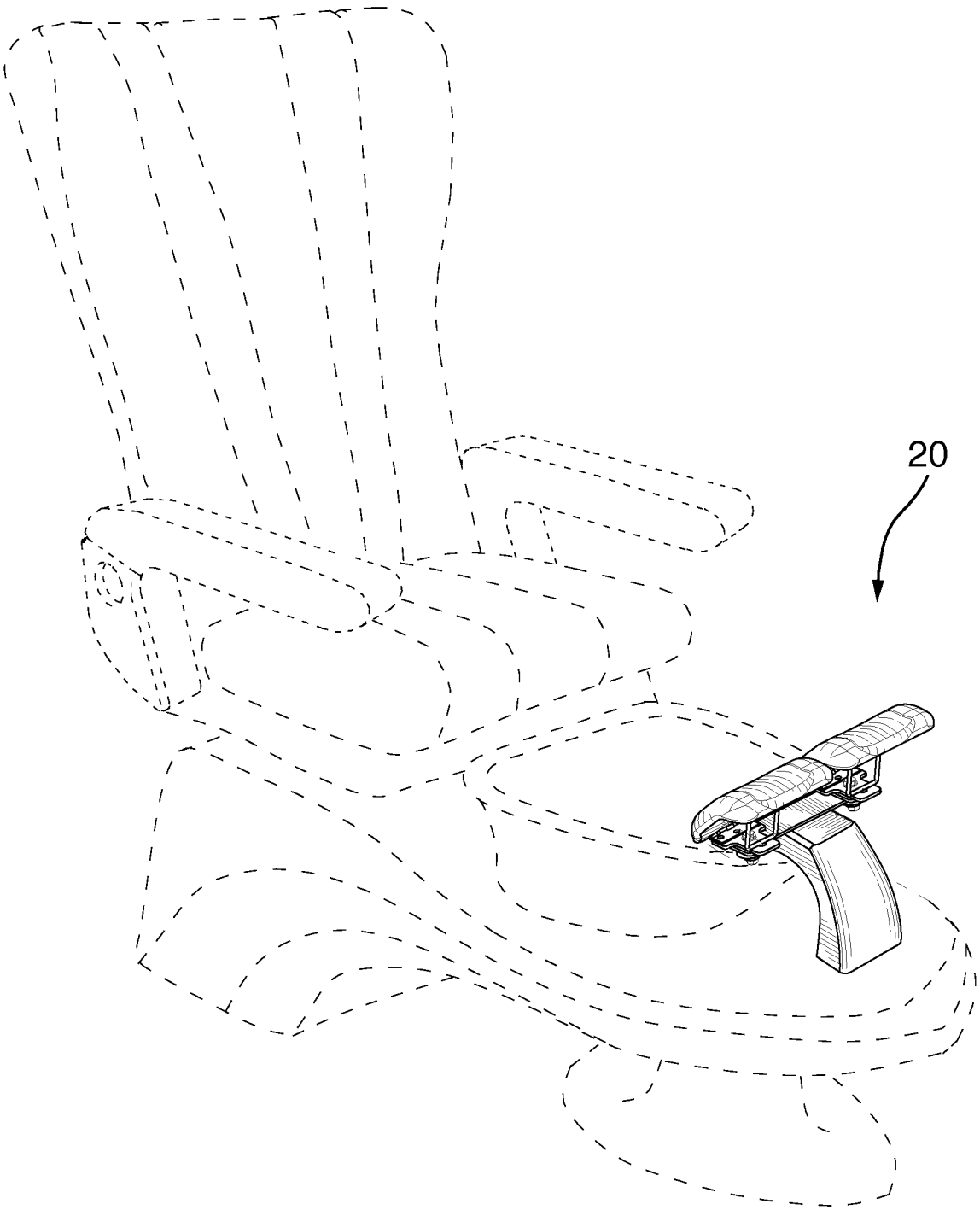
FIG. 14 is a view similar to FIG. 4 with the left pad in the third position and the right pad in the third position.
Figure 15:
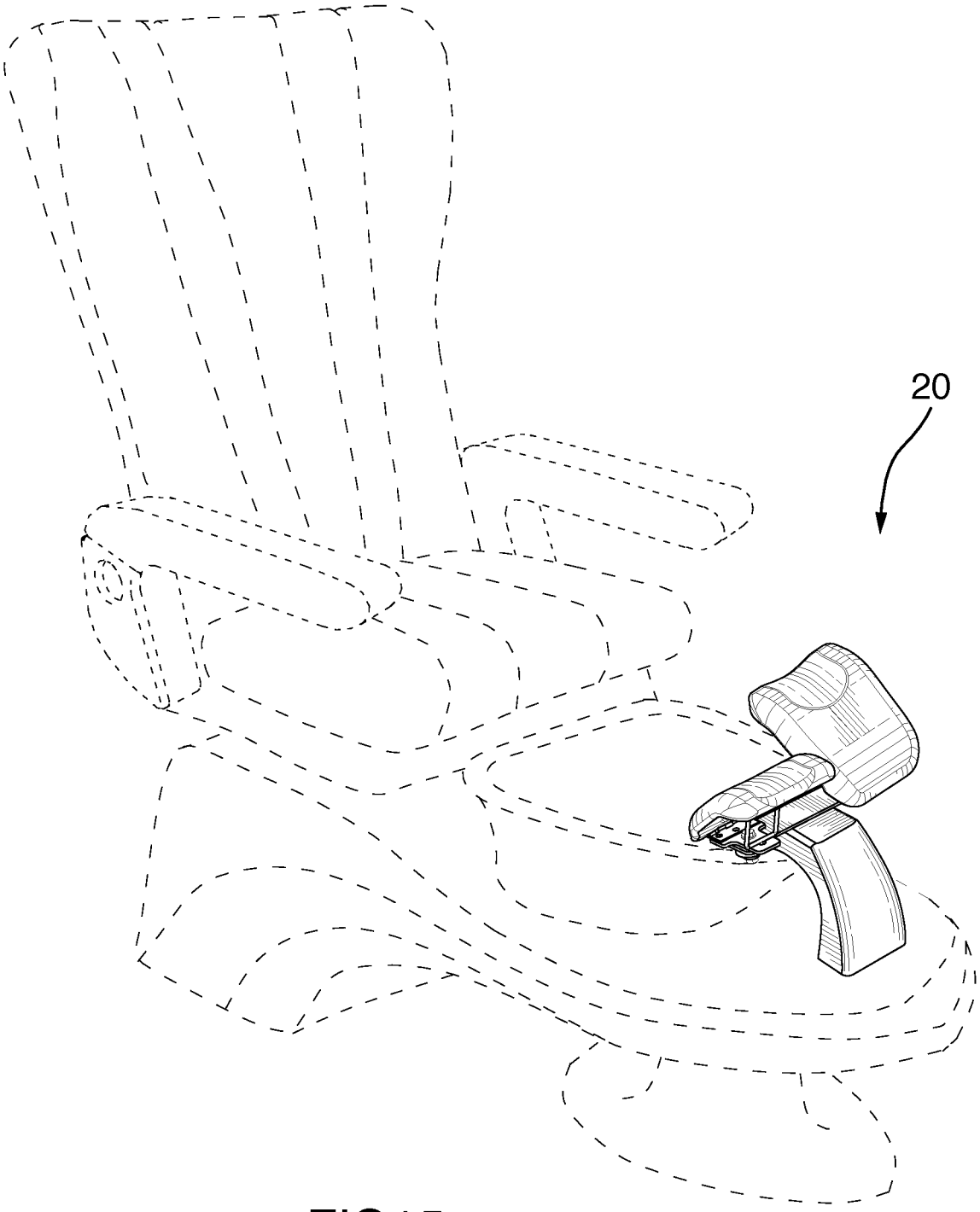
FIG. 15 is a view similar to FIG. 4 with the left pad in the fourth position and the right pad in the third position.
Figure 16:
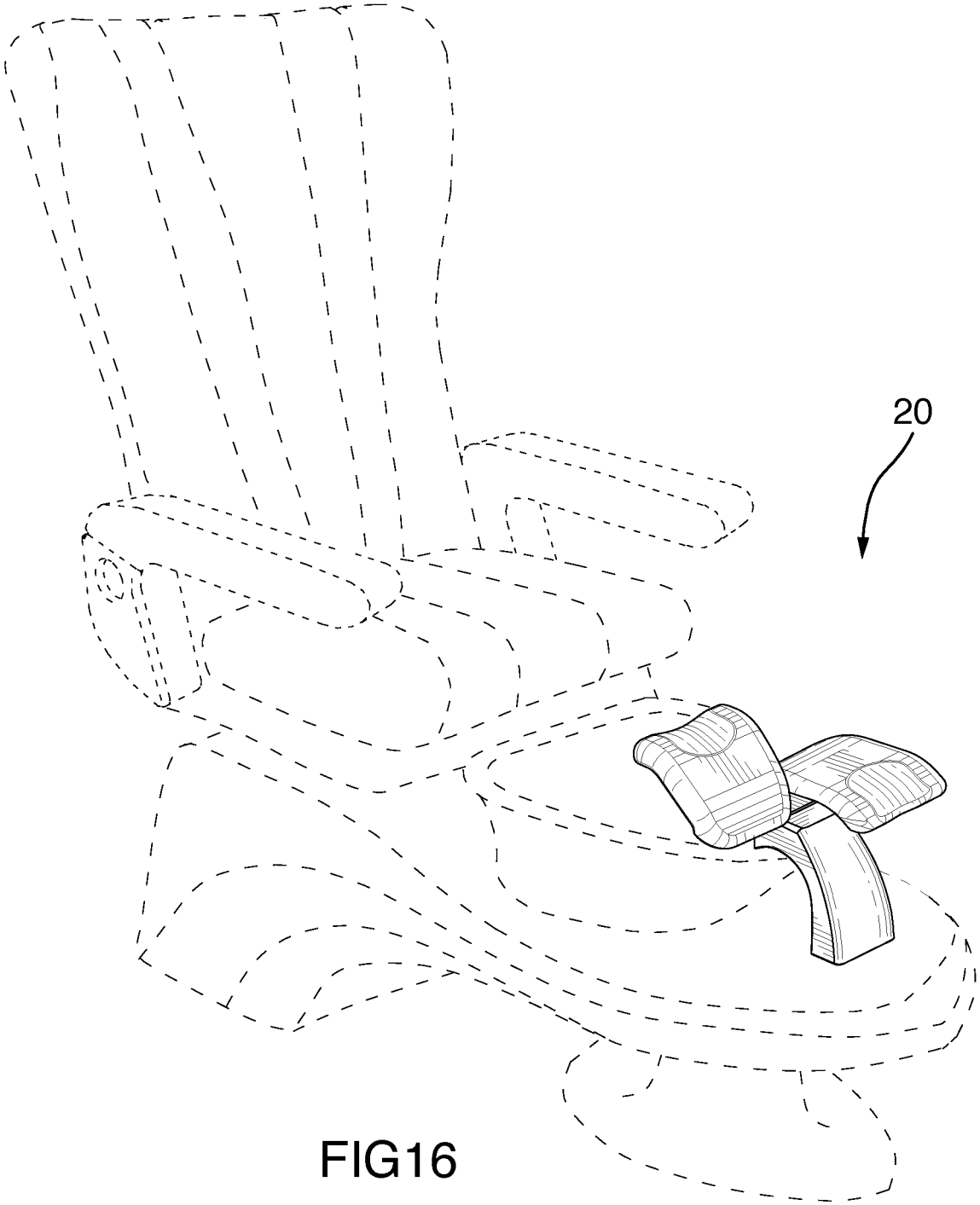
FIG. 16 is a view similar to FIG. 4 with the left pad in the first position and the right pad in the fourth position.
Figure 17:
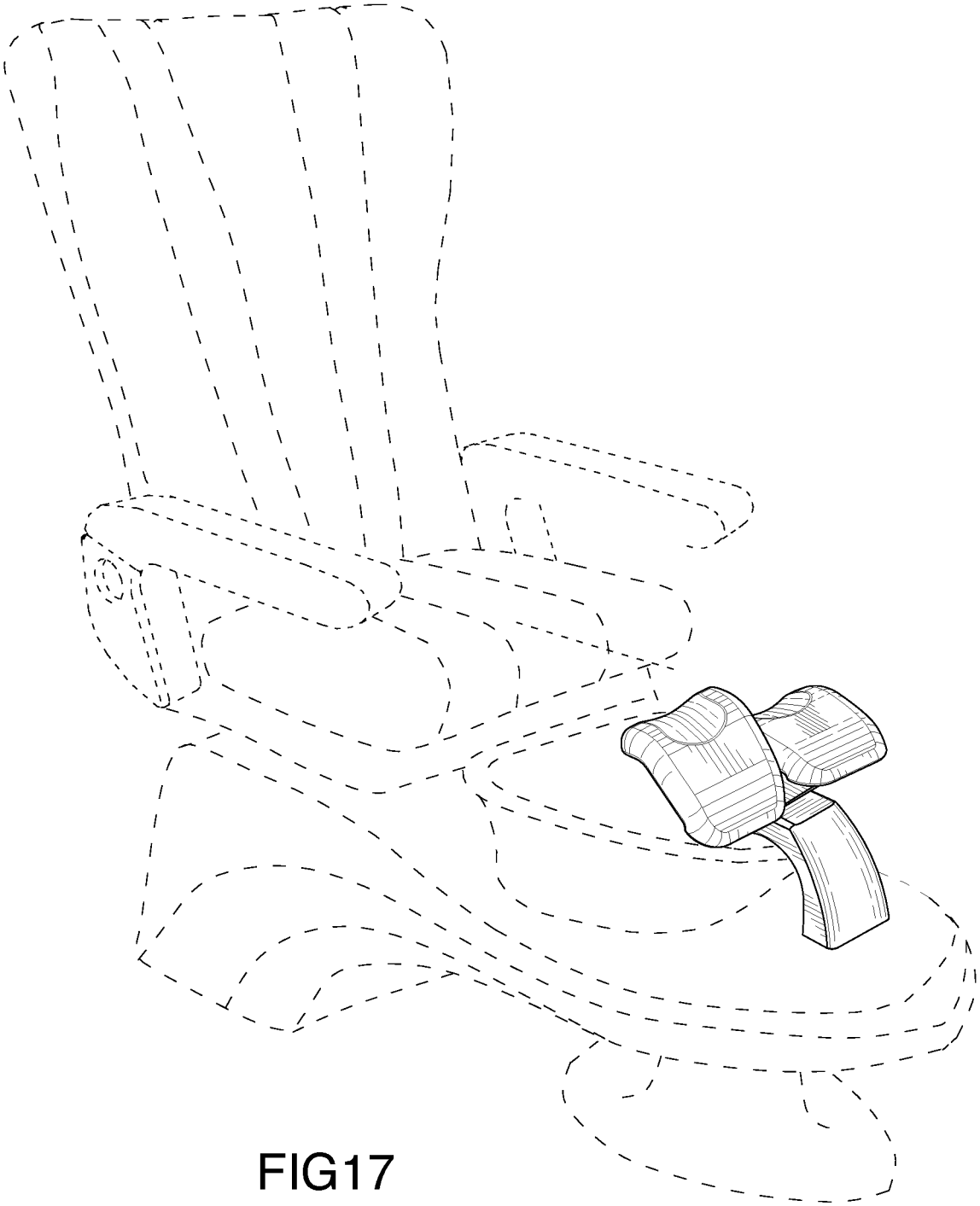
FIG. 17 is a view similar to FIG. 4 with the left pad in the second position and the right pad in the fourth position.
Figure 18:
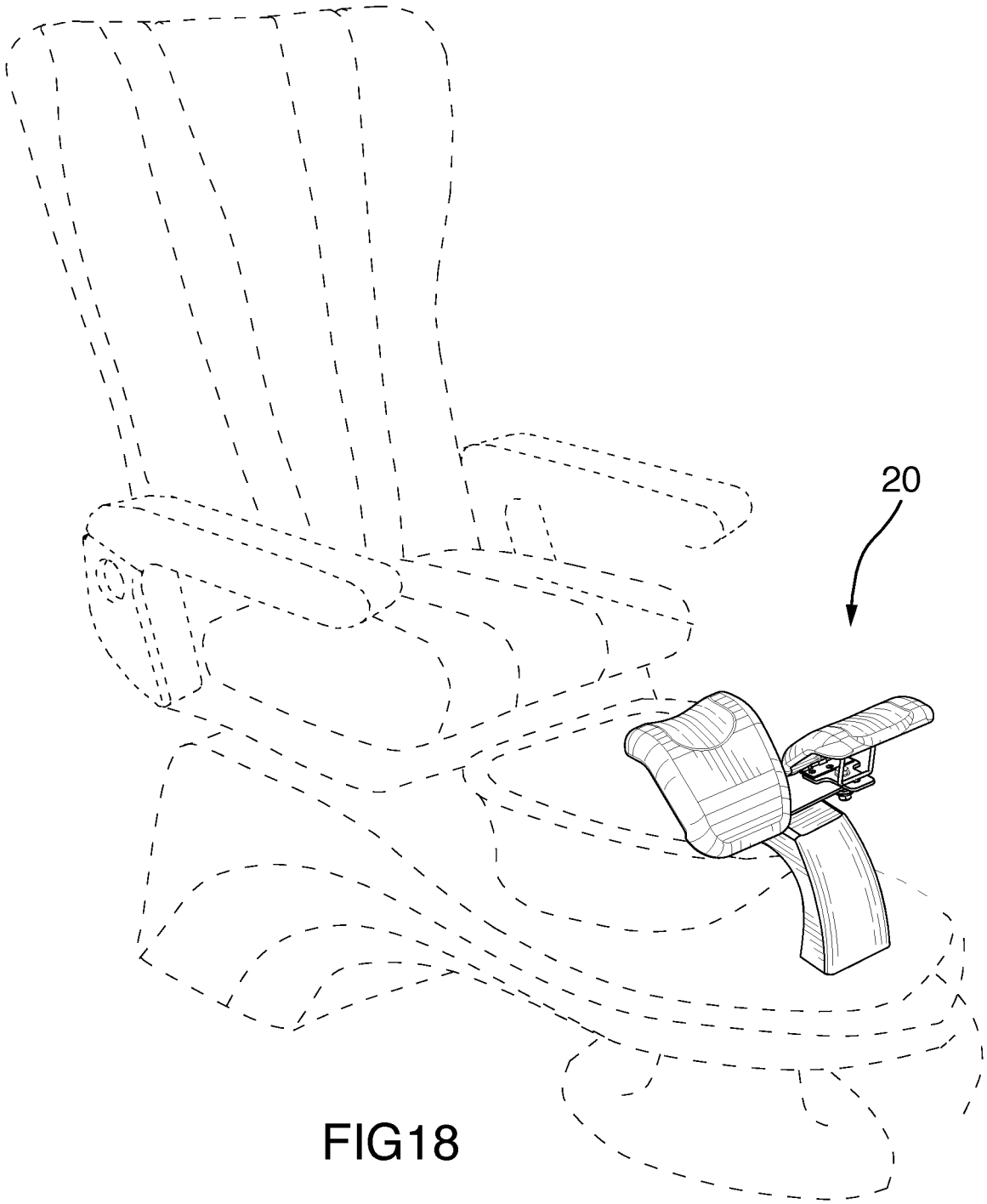
FIG. 18 is a view similar to FIG. 4 with the left pad in the third position and the right pad in the fourth position.
Figure 19:
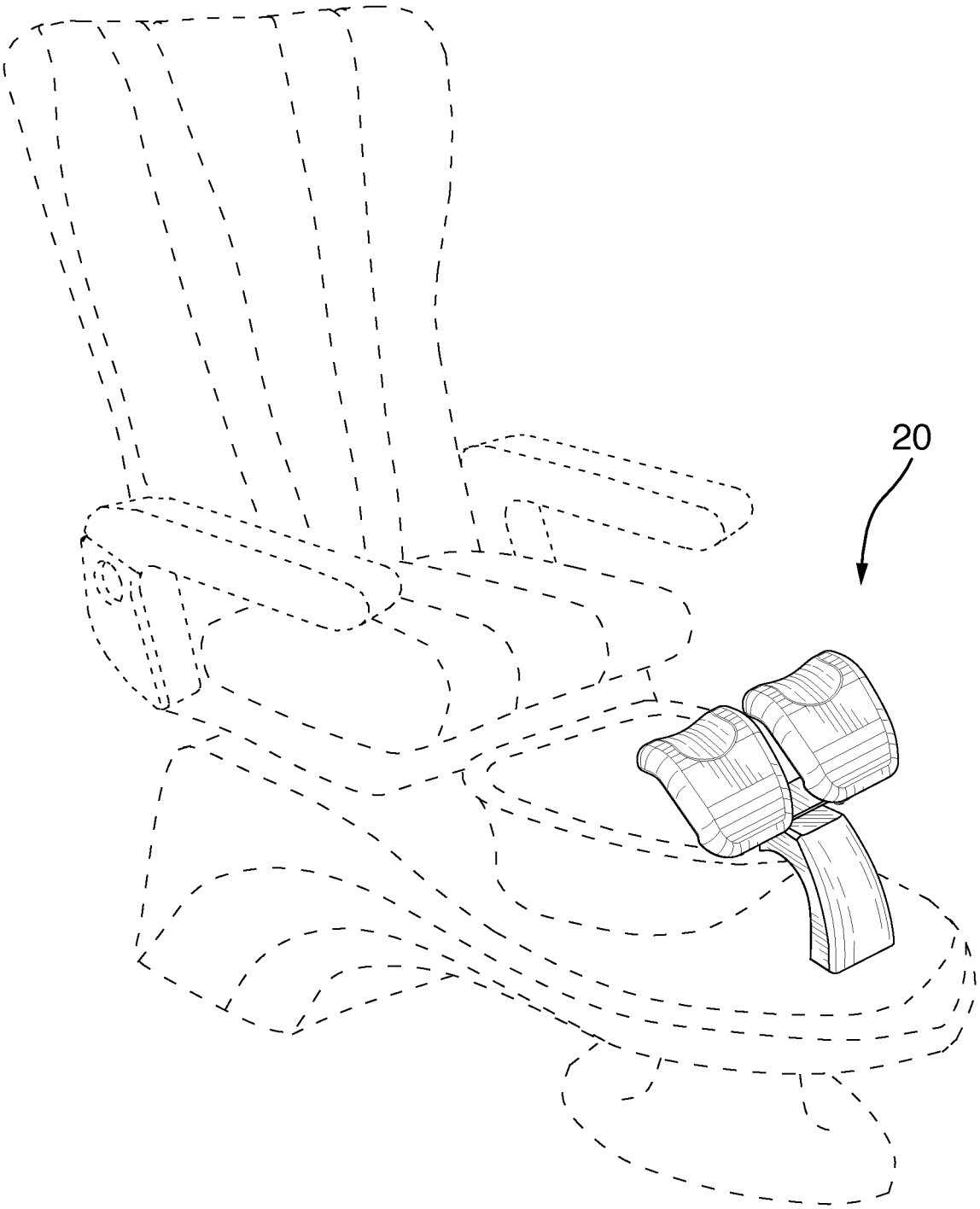
FIG. 19 is a view similar to FIG. 4 with the left pad in the fourth position and the right pad in the fourth position.

Apparatus 20 will be understood to be for use by a two-legged person 200 and with a subassembly 100, subassembly 100 including a seat 102 and bowl 104, the bowl 104 being disposed beneath the seat 102 and adapted for receiving water, the seat 102 and bowl 104 being adapted such that the feet of the person can, in use, be immersed in water in the bowl while the seat is operatively occupied by the person, all as indicated in FIG. 3.

The apparatus is shown in combination with the foot spa subassembly in FIGS. 4-19, wherein it will be seen that: the pivot axis is horizontal; the rotation axis is vertical; the bushings are operatively mounted to the subassembly; the hinges and shaft and bushing arrangements provide for movement of the pads such that the pads can each assume one of four positions as indicated in Table 1; and the pads are positioned relative to one another such that, in use, when the pads are in the same position, the pads are spaced apart from one another in the same direction as that which defines the space between the ischial bones of the seated person.

TABLE 1

| Figure | Left Pad Position | Right Pad Position |
|---|---|---|
| 4 | 1 | 1 |
| 5 | 2 | 1 |
| 6 | 3 | 1 |
| 7 | 4 | 1 |
| 8 | 1 | 2 |
| 9 | 2 | 2 |
| 10 | 3 | 2 |
| 11 | 4 | 2 |
| 12 | 1 | 3 |
| 13 | 2 | 3 |
| 14 | 3 | 3 |
| 15 | 4 | 3 |
| 16 | 1 | 4 |
| 17 | 2 | 4 |
| 18 | 3 | 4 |
| 19 | 4 | 4 |

Having regard to the figures, it will be understood characteristics are associated with pad position of the exemplary embodiment as indicated in Table 2:

TABLE 2

| Pad Position | Characteristics |
|---|---|
| 1 | base is proximal to the seat<br>end is distal to the seat<br>pad extends substantially horizontally from base to end<br>central portion is generally horizontal and presents upwardly<br>pintle presents downwardly and received by the socket<br>to arrest movement of the plate around the vertical axis. |
| 2 | end is proximal to the seat; base is distal to the seat<br>the pad extends substantially horizontally from base to end<br>planar central portion is generally horizontal and presents upwardly<br>pintle presents downwardly and received by the socket to arrest<br>movement of the plate around the vertical axis |
| 3 | base is proximal to seat<br>end is distal to the seat end is elevated above base<br>trough-shaped depression is generally horizontal and presents<br>upwardly<br>aperture receives locking pin to arrest movement of the plate around<br>the vertical axis and to support the pad |
| 4 | end is proximal to seat<br>base is distal to seat<br>end is elevated above base<br>trough-shaped depression is generally horizontal and presents<br>upwardly |

TABLE 2-continued

| Pad Position | Characteristics |
|---|---|
| | aperture receives locking pin to arrest movement of the plate around the vertical axis and to support the pad |

Figure 20:
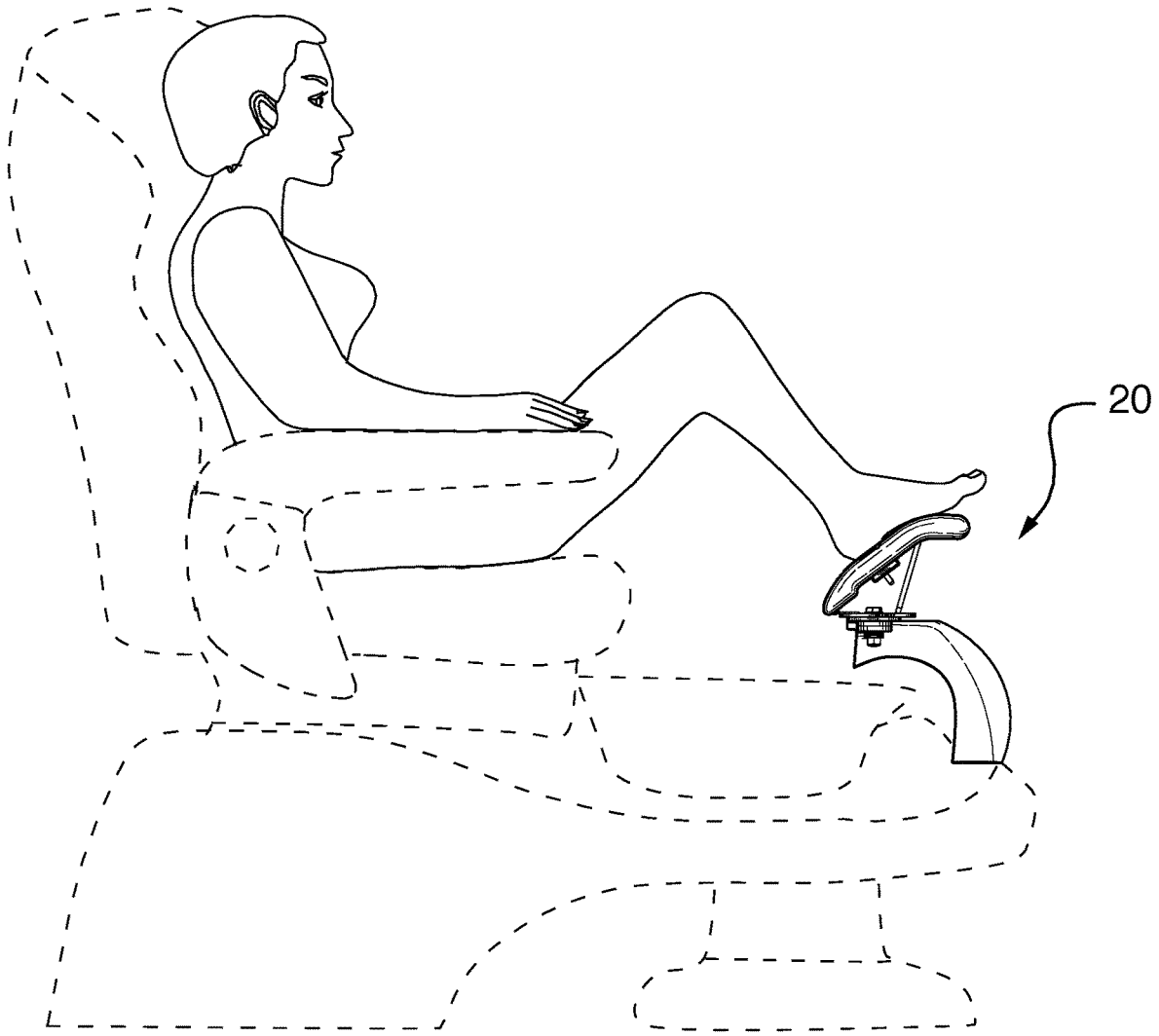
FIG. 20 is a view of the structure of FIG. 1 in use with the structure of FIG. 3, wherein left pad and right pad are both in position 3.

Persons of ordinary skill will ready appreciate that the variable geometry of the pads provide great flexibility in foot placement, thereby to enable estheticians to work various portions of the feet while maintaining comfort on the part of the patron, as indicated, by way of example only, in FIG. 20 wherein left pad and right pad are both in position 3

Figure 21:
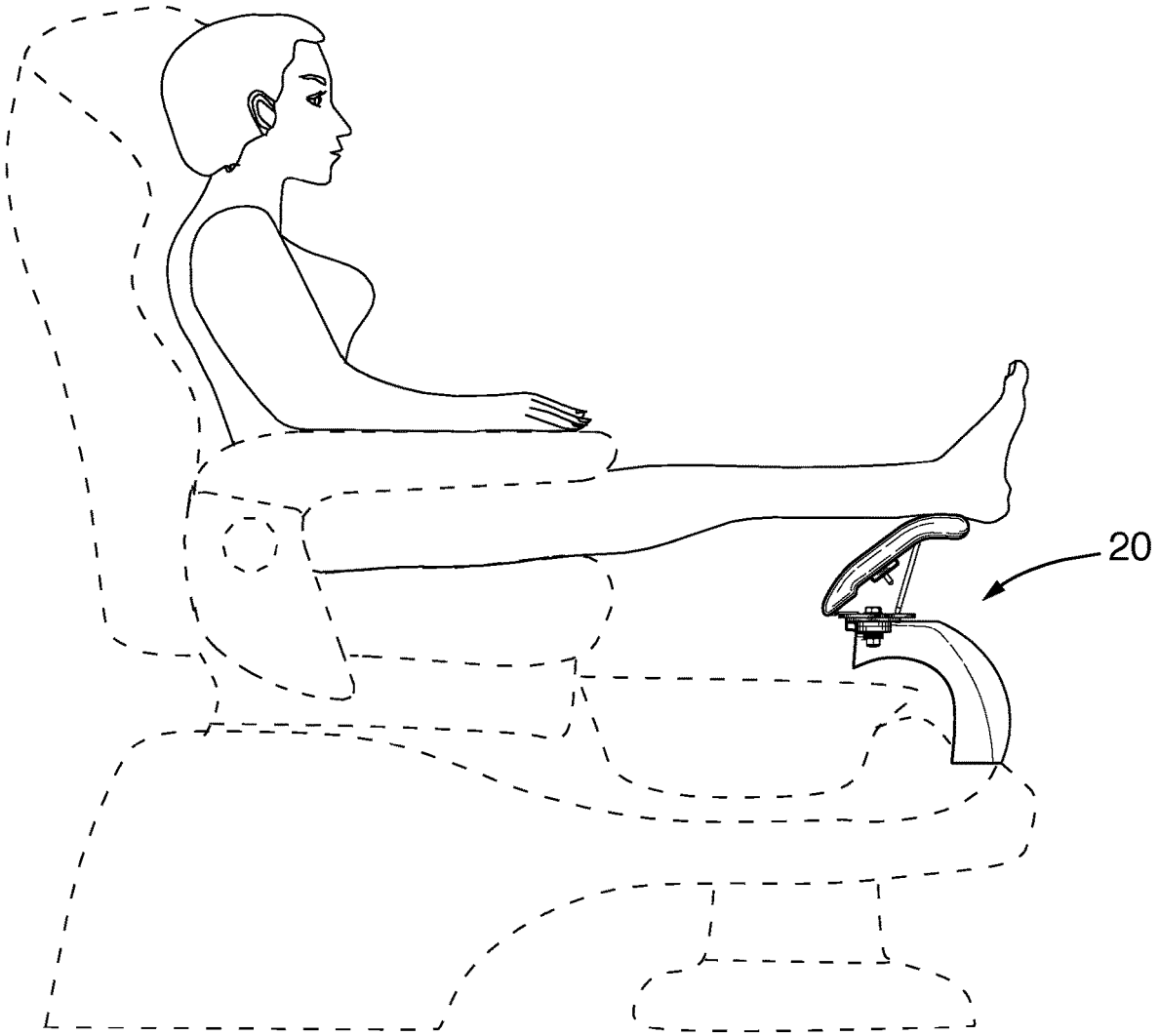
FIG. 21 is a view similar to FIG. 20 wherein the left pad and right pad are both in position 3.

FIG. 21 wherein left pad and right pad are both in position 3

Figure 22:
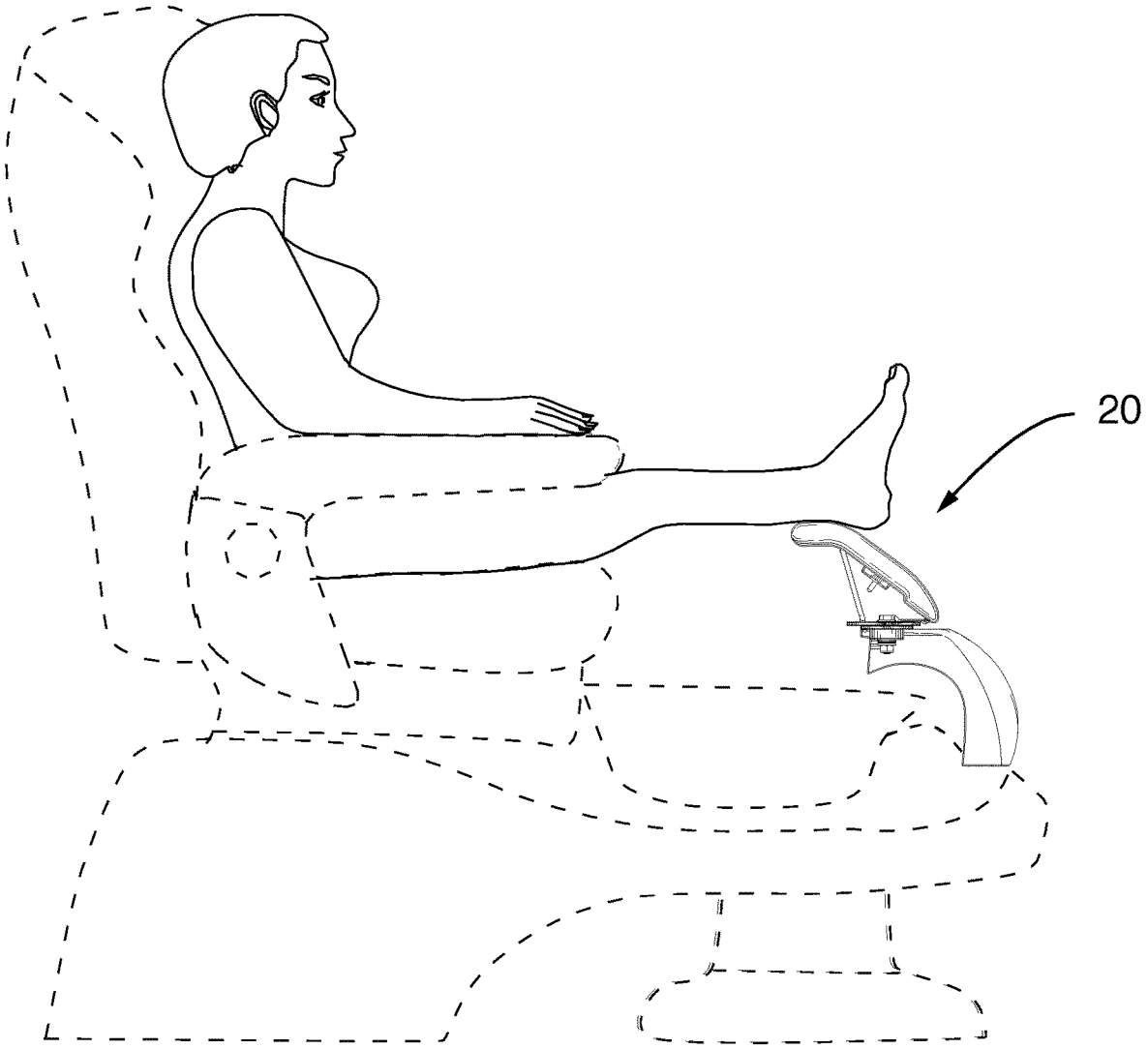
FIG. 22 is a view similar to FIG. 20, wherein the left pad and right pad are both in position 4.

FIG. 22 wherein left pad and right pad are both in position 4

Figure 23:
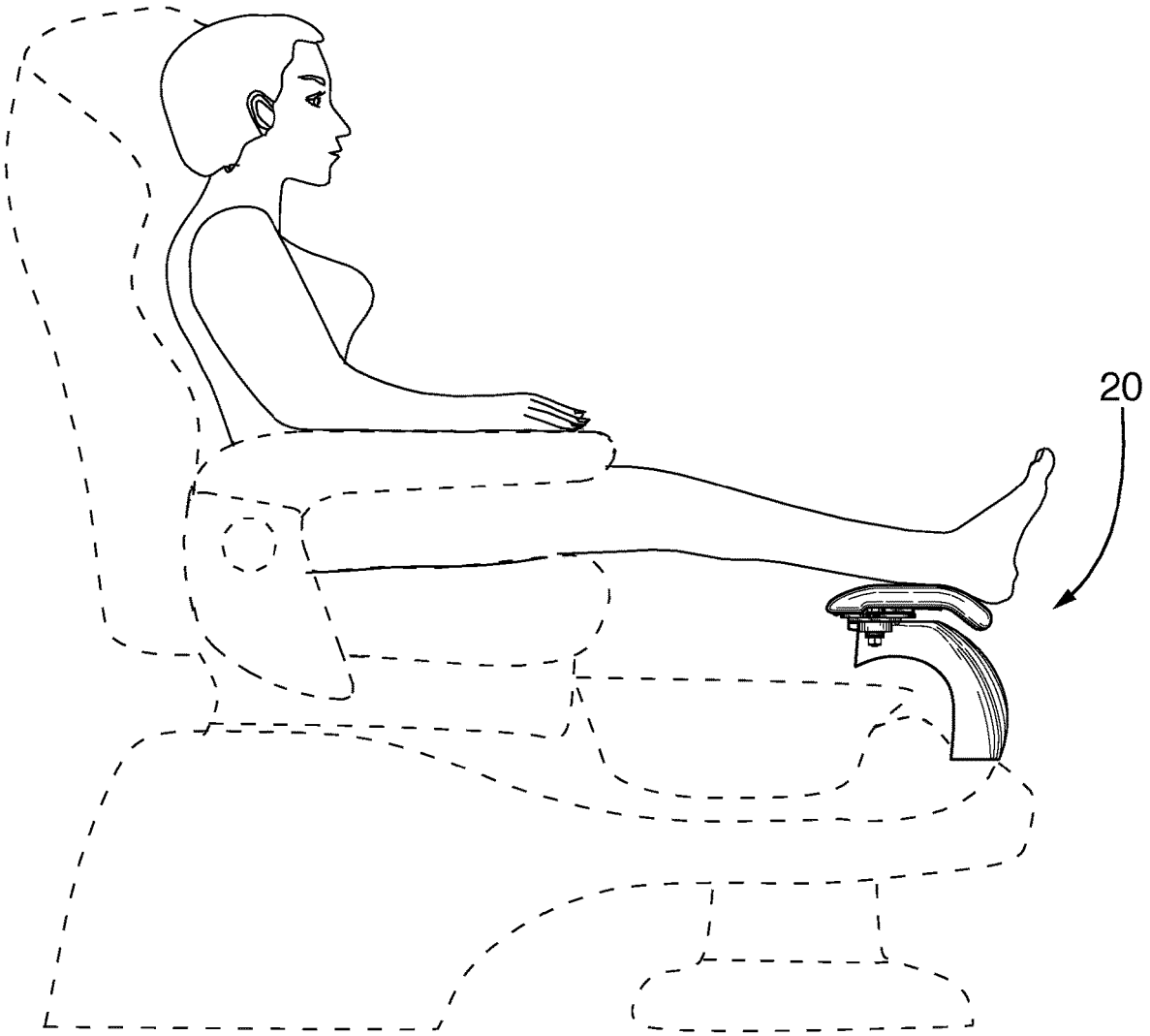
FIG. 23 is a view similar to FIG. 20, wherein the left pad and right pad are both in position 1.

FIG. 23 wherein left pad and right pad are both in position 1

Figure 24:
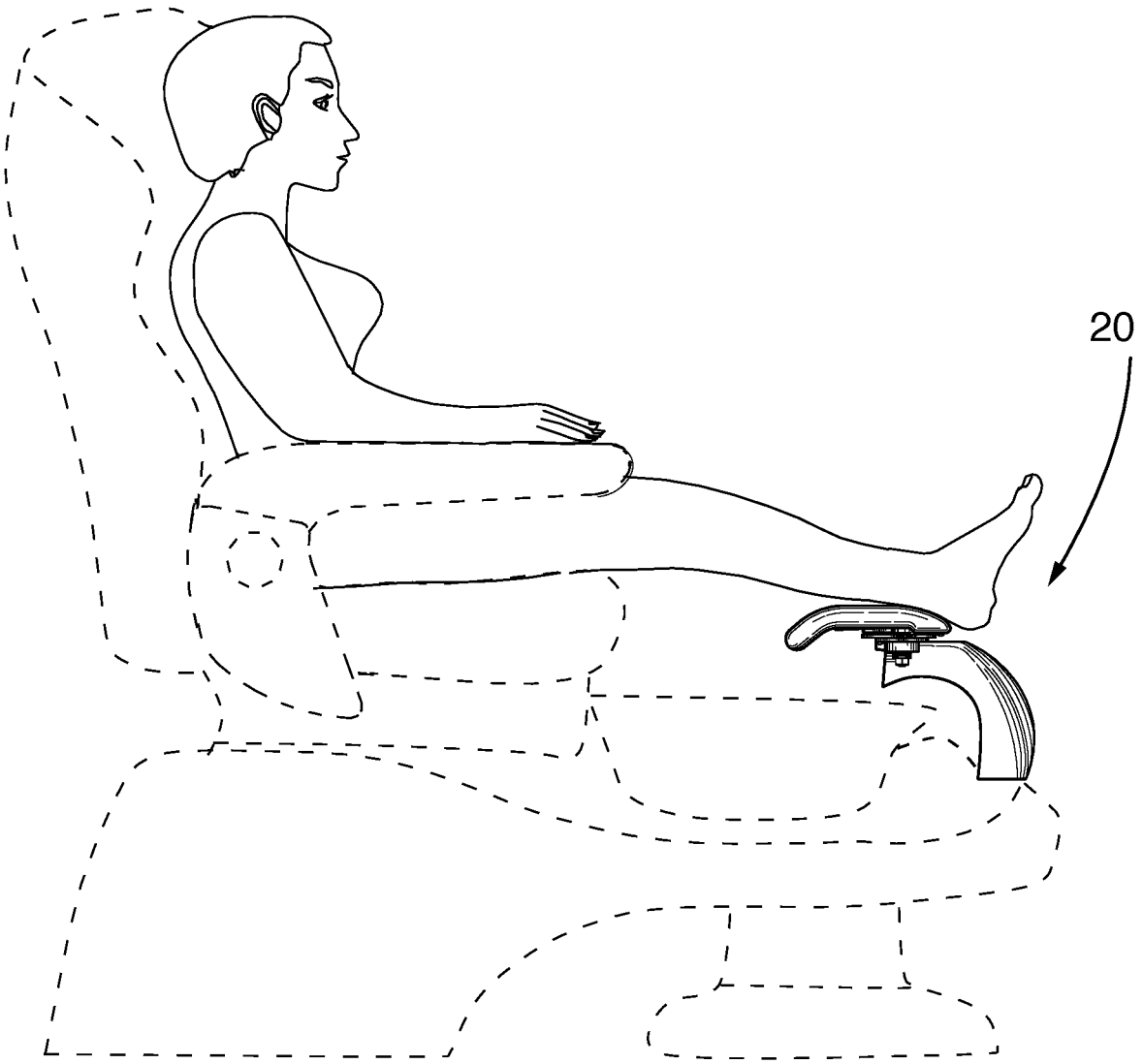
FIG. 24 is a view similar to FIG. 20, wherein the left pad and right pad are both in position 2.

FIG. 24 wherein left pad and right pad are both in position 2

Figure 25:
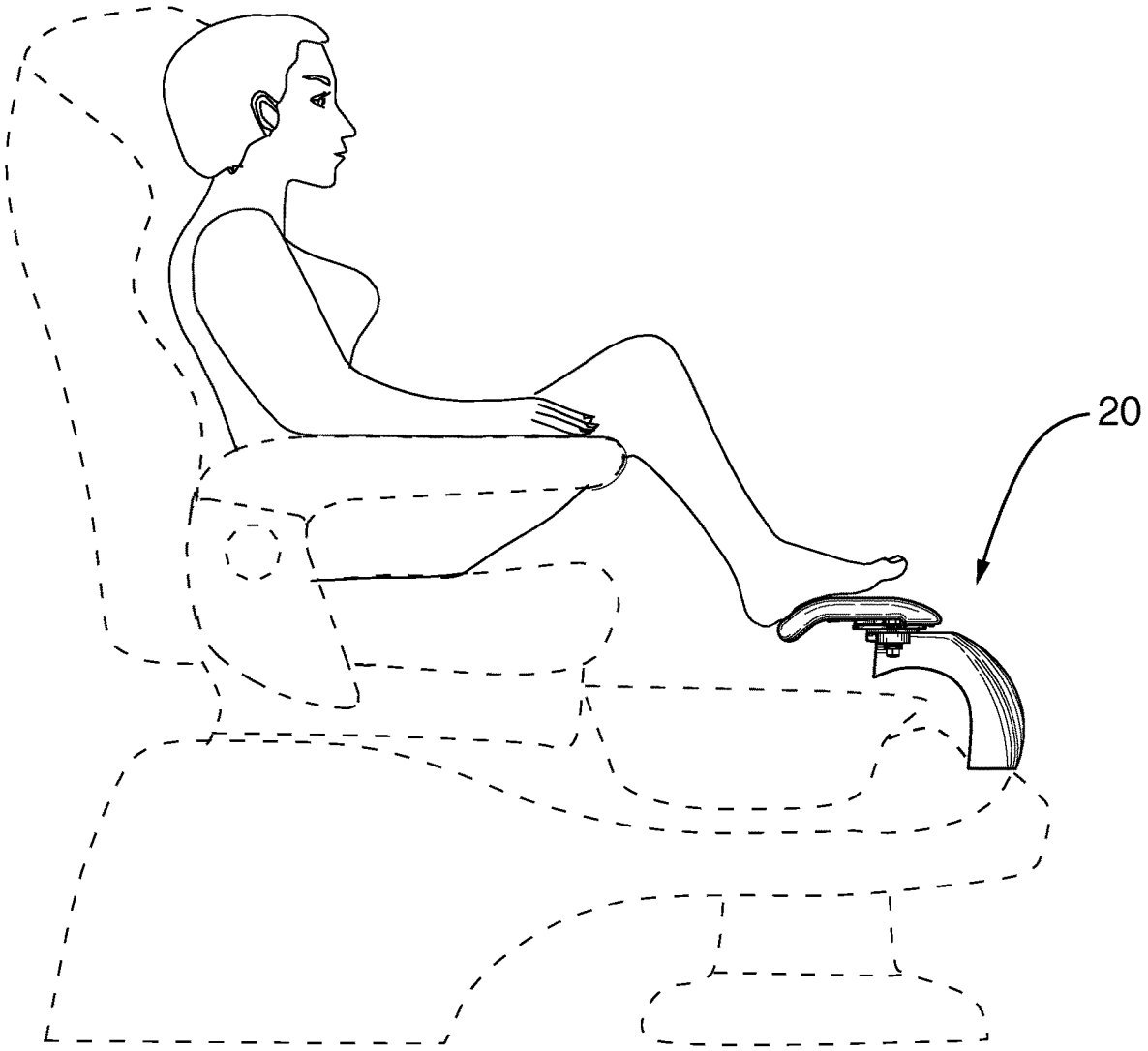
FIG. 25 is a view similar to FIG. 20, wherein the left pad and right pad are both in position 2.

FIG. 25 wherein left pad and right pad are both in position 2

Whereas a specific structure is shown and described, it will be appreciated that variations are possible without departing from the inventive concept: the pad shape can change other mechanisms can be used to provide for the pads to be held against rotation; the shaft and hinge plate, for example, might be separable from the bushing and a key or similar arrangement could be provided at the interface between the hinge plate and the bushing other mechanism can be used to support the pads in the third and fourth positions; for example, the locking pin could be pivotally mounted to the hinge plate and engage a socket in the underside of the pad.

Accordingly, the invention should be understood to be limited only by the accompanying claims, purposively construed.

The invention claimed is:

1. An apparatus for use by a two-legged person and with a foot spa subassembly, the subassembly including a seat and a bowl, the bowl being disposed beneath the seat and adapted for receiving water, the seat and bowl being adapted such that the feet of the person can, in use, be immersed in water in the bowl while the seat is operatively occupied by the person, the apparatus comprising:

a pad provided for each leg of the person, the pad being positioned in use such that the bowl is disposed between and beneath the seat and the pad, the pad having a base and an end and having, in use:

a first position wherein the base is proximal to the seat, the end is distal to the seat and the pad extends substantially horizontally from the base to the end;

a second position wherein the end is proximal to the seat, the base is distal to the seat and the pad extends substantially horizontally from the base to the end;

a third position wherein the base is proximal to the seat, the end is distal to the seat and the end is elevated above the base;

a fourth position wherein the end is proximal to the seat, the base is distal to the seat and the end is elevated above the base, the pads being positioned relative to one another such that, in use, when the pads are in the same position, the pads are spaced apart from one another in the same direction as that which defines the space between the ischial bones of the seated person.

2. The apparatus according to claim 1, further comprising a hinge for each pad, the hinge defining, in use, a horizontal axis adjacent the base of said each pad; and a shaft and bushing arrangement which defines, in use, a vertical axis about which the hinge rotates, the hinge and shaft providing for movement of the pad between the first, second, third and fourth positions.

3. The apparatus according to claim 2, wherein the pad has a planar central portion that, in use, is generally horizontal and presents upwardly in the first and second positions.

4. The apparatus according to claim 3, further comprising a pintle projecting from the pad opposite to the central portion such that, in the first and second position of the pad, the pintle depends downwardly;

wherein the hinge has a plate which, in use, is planar and which is mounted for pivotal movement around the vertical axis by the shaft and bushing arrangement; and wherein the plate has an aperture presenting upwardly in use which, in the first and second position of the pad, receives the pintle to arrest movement of the plate around the vertical axis.

5. The apparatus according to claim 4, further comprising a locking pin pivotally connected to the base at a location adjacent the end and opposite to the central portion, the aperture, in the third and fourth positions of the pad, receiving the locking pin to arrest movement of the plate around the vertical axis and to support the pad in the third and fourth positions.

6. The apparatus according to claim 3 wherein the base and end are radiused so as to present in combination with the planar central portion a generally convex surface.

7. The apparatus according to claim 1 wherein the end of the pad has a through-shaped depression that, in use, is generally horizontal and presents upwardly in the third and fourth positions.

* * * * *